US010920507B2

(12) United States Patent
Vavik

(10) Patent No.: US 10,920,507 B2
(45) Date of Patent: Feb. 16, 2021

(54) DRILLING SYSTEM AND METHOD

(71) Applicant: Future Well Control AS, Kristiansand (NO)

(72) Inventor: Dag Vavik, Kristiansand (NO)

(73) Assignee: Future Well Control AS, Kristiansand (NO)

( * ) Notice: Subject to any disclaimer, the term of this patent is extended or adjusted under 35 U.S.C. 154(b) by 134 days.

(21) Appl. No.: 16/098,090

(22) PCT Filed: May 24, 2017

(86) PCT No.: PCT/IB2017/053052
§ 371 (c)(1),
(2) Date: Oct. 31, 2018

(87) PCT Pub. No.: WO2017/115344
PCT Pub. Date: Jul. 6, 2017

(65) Prior Publication Data

US 2019/0145202 A1 May 16, 2019

(30) Foreign Application Priority Data

May 24, 2016 (NO) ..... 20160881

(51) Int. Cl.
*E21B 7/12* (2006.01)
*E21B 21/00* (2006.01)
(Continued)

(52) U.S. Cl.
CPC ..... *E21B 21/08* (2013.01); *E21B 7/12* (2013.01); *E21B 21/001* (2013.01); *E21B 21/10* (2013.01)

(58) Field of Classification Search
CPC ..... E21B 7/12; E21B 21/001; E21B 21/08; E21B 21/10
See application file for complete search history.

(56) References Cited

U.S. PATENT DOCUMENTS 8,640,778 B2 * 2/2014 Fossli ..... E21B 33/06 166/367
9,163,466 B2 10/2015 Vavik
(Continued)

FOREIGN PATENT DOCUMENTS

GB 2506400 A 4/2014
WO WO2009123476 A1 10/2009
(Continued)

OTHER PUBLICATIONS

Norwegian Search Report (Granskingsrapport)) for Norsk Patentsøknads No. 20160881 dated Dec. 13, 2016 (2 pages).
(Continued)

*Primary Examiner* — Matthew R Buck
(74) *Attorney, Agent, or Firm* — Peter I. Brewer; Thrive IP

(57) ABSTRACT

A method for managed pressure drilling comprising: extending a drilling riser with a drill string from a floating installation to a subsea blow-out preventer stack; providing a first fluid in the drilling riser annulus and a second fluid in a fluid conduit extending from the floating installation, where the first fluid has a higher density than the second fluid; circulating the second fluid through a control valve which is fluidly connected to the fluid conduit and operating the control valve to apply a surface back-pressure so as to obtain a pre-determined, desired combined hydrostatic and frictional circulation pressure below the subsea blow-out preventer stack.

26 Claims, 7 Drawing Sheets

(51) Int. Cl.
*E21B 21/08* (2006.01)
*E21B 21/10* (2006.01)

(56) References Cited

U.S. PATENT DOCUMENTS

| | | | | |
|---|---|---|---|---|
| 9,759,025 | B2 | 9/2017 | Vavik | |
| 9,828,847 | B2 | 11/2017 | Vavik | |
| 9,869,158 | B2 | 1/2018 | Vavik | |
| 10,648,281 | B2 | 5/2020 | Vavik | |
| 2002/0117332 | A1 | 8/2002 | Dawson et al. | |
| 2012/0227978 | A1* | 9/2012 | Fossli | E21B 43/38 166/363 |
| 2013/0192841 | A1 | 8/2013 | Feasey et al. | |
| 2013/0206423 | A1 | 8/2013 | Weinstock et al. | |
| 2014/0048331 | A1* | 2/2014 | Boutalbi | E21B 21/106 175/38 |
| 2015/0068758 | A1* | 3/2015 | Leuchtenberg | E21B 21/001 166/336 |
| 2015/0252637 | A1* | 9/2015 | Leuchtenberg | E21B 21/08 175/5 |
| 2018/0038177 | A1* | 2/2018 | Leuchtenberg | E21B 17/01 |

FOREIGN PATENT DOCUMENTS

| | | | |
|---|---|---|---|
| WO | WO2011058031 | A2 | 5/2011 |
| WO | WO2016105205 | A1 | 6/2016 |
| WO | WO2012095340 | A2 | 7/2017 |
| WO | WO2017115344 | A2 | 7/2017 |

OTHER PUBLICATIONS

International Search Report for PCT/IB2017/053052 dated Aug. 1, 2017 (5 pages).

Nancy Bazilchuk; Norwegian SciTech News, "New Lessons from the Worst Oil Spill Disaster Ever," published Jun. 20, 2020; 8 pages.

Zhang Liang, et al.; Petroleum Exploration and Development Article, "Gas Hydrate Risks and Prevention," Petroleum Exploration and Development; vol. 41, Issue 6; published Dec. 2014; 9 pages.

D. Vavik, et al.; SPE Article, "Gas in the Riser," IADC/SPE Managed Pressure Drilling and Underbalanced Operations Conference and Exhibition; published Mar. 2017; Rio de Janeiro, Brazil, 12 pages.

D. Vavik, et al.; SPE Article, "Loss of Circulation," SPE/IADC Managed Pressure Drilling and Underbalanced Operations Conference and Exhibition; published Apr. 2016; Galveston, Texas; 14 pages.

* cited by examiner

DRILLING SYSTEM AND METHOD

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

STATEMENT OF RELATED APPLICATIONS

This application claims priority to International Patent Application No PCT/IB2017/053052. That application was filed on May 24, 2017 and is entitled "Drilling System and Method." The PCT application has been published as WO 2017/115344.

The PCT application claimed priority to Norwegian Patent Application 20160881 filed 24 May 2016, having the same title.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to a drilling system and method, including but not limited to a drilling system and method suitable for use with managed pressure drilling.

Discussion of Technology

Managed pressure drilling (MPD) techniques such as constant bottom hole pressure (CBHP) and pressurized mud cap drilling (PMCD) have been used previously to drill challenging prospects that with conventional techniques are considered un-drillable. As the industry moves to deeper water with conventional marine drilling riser and subsea blow-out preventer (BOP) stack technology, several dual gradient techniques have also been developed, such as:

Subsea mud-lift (pumps near the seafloor)

Controlled annular mud level (pumps shallower to the rig)

Mud dilution (with concentric casing, liner or riser)

Inert gas injection (with parasite string).

Also more traditional MPD techniques such as CBHP and PMCD with the use of a rotating control device (RCD) and a pressure control valve (PCV), also commonly referred to as a MPD choke to apply surface back-pressure, have been used in combination with a subsea BOP stack.

A challenge with these systems is that both drilled gas and inadvertent influx of gas above the subsea BOP stack needs to be treated in a "low pressure" system. While the subsea BOP stack and the kill and choke lines are pressure rated for full wellhead shut-in pressure, the marine drilling riser and RCD, typically located in the upper part of the riser, are commonly rated for a lower pressure. The complexity, capital expenditure (Cap Ex) and operating expenses (Op Ex) of these systems are also relatively high.

Another challenge with the prior art is that gas trapped in gas hydrates or dissolved in the drilling fluid will not be released before the pressure is sufficiently low. In deep water with a subsea BOP stack, this release of gas will typically occur in the "low pressure" marine drilling riser. Consequently, potentially large amounts of gas and drilling fluid have to be treated in the "low pressure" system, either by the diverter system for conventional drilling and controlled mud level (CIVIL) systems or by means of an RCD or annular sealing element, located in the upper part of the riser, in combination with an MPD choke if an MPD or riser gas handling system is available. In an MPD application with a dry or surface installed BOP stack however, the RCD is typically located as close as possible above the surface BOP stack and the total volume of gas and drilling fluid that needs to be treated above the BOP stack is very limited, and even more important the release of gas from the drilling fluid will typically occur below the BOP stack. On a surface BOP stack, the BOP can therefore be shut-in and released gas and drilling fluid can be treated in a conventional way without the pressure limitation given by the "low pressure" marine drilling riser and the RCD.

Another challenge when drilling with a floating drilling unit and a subsea BOP stack in harsh environments is the surge and swab effects caused by the waves. When the drill pipe is fixed to the rig or vessel during connections, the drill pipe will move up and down in the open wellbore like a piston and may cause relatively large pressure fluctuations. These pressure fluctuations caused by surge and swab effects during connection have been found difficult to compensate with traditional MPD techniques such as CBHP. The consequence will be that it can be very challenging to operate within a narrow drilling window given by the highest pore pressure gradient and the lowest fracture gradient.

Yet another challenge with the prior art of MPD techniques independent if the method is used in combination with a surface BOP stack or a subsea BOP stack, is their limitation to handle crossflow. Crossflow is defined by the Schlumberger Oilfield Glossary as:

> "The flow of reservoir fluids from one zone to another. Crossflow can occur when a lost returns event is followed by a well control event. The higher pressured reservoir fluids flow out of the formation, travels along the wellbore to a lower pressured formation, and then flows into the lower pressure formation."

In prior art MPD techniques, the MPD system has been used to manage the downhole annular wellbore pressure slightly above the pore pressure of the higher pressured formation but at the same time below the fracture pressure of the lower pressured formation. The MPD process may utilize a variety of techniques in order to relative rapidly perform corrective actions by changing the downhole annular wellbore pressure. The method commonly used for corrective actions is to increase the downhole annular pressure if an influx event is detected and likewise to decrease the downhole annular pressure if a lost returns event is detected. However this method does not solve the fundamental problem with crossflow.

Documents which can be useful for further understanding the background include: US 2012/0227978; US 2013/0192841; WO 2009/123476; US 2015/0252637; US 2014/0048331; and WO 2016/105205.

There is, consequently, a need for improved systems and methods to enable safer, more cost efficient and/or more time efficient drilling, in particular in relation to challenging wells and reservoirs. The present invention has the objective to provide such improvements in at least one of the above-mentioned aspects.

SUMMARY OF THE INVENTION

Embodiments according to the present invention are outlined in the appended independent claims. Alternative and/or particularly advantageous embodiments are outlined in the dependent claims.

BRIEF DESCRIPTION OF THE DRAWINGS

Illustrative embodiments, given as a non-restrictive examples, will now be described with reference to the attached drawings wherein.

DETAILED DESCRIPTION OF CERTAIN EMBODIMENTS

Figure 1:
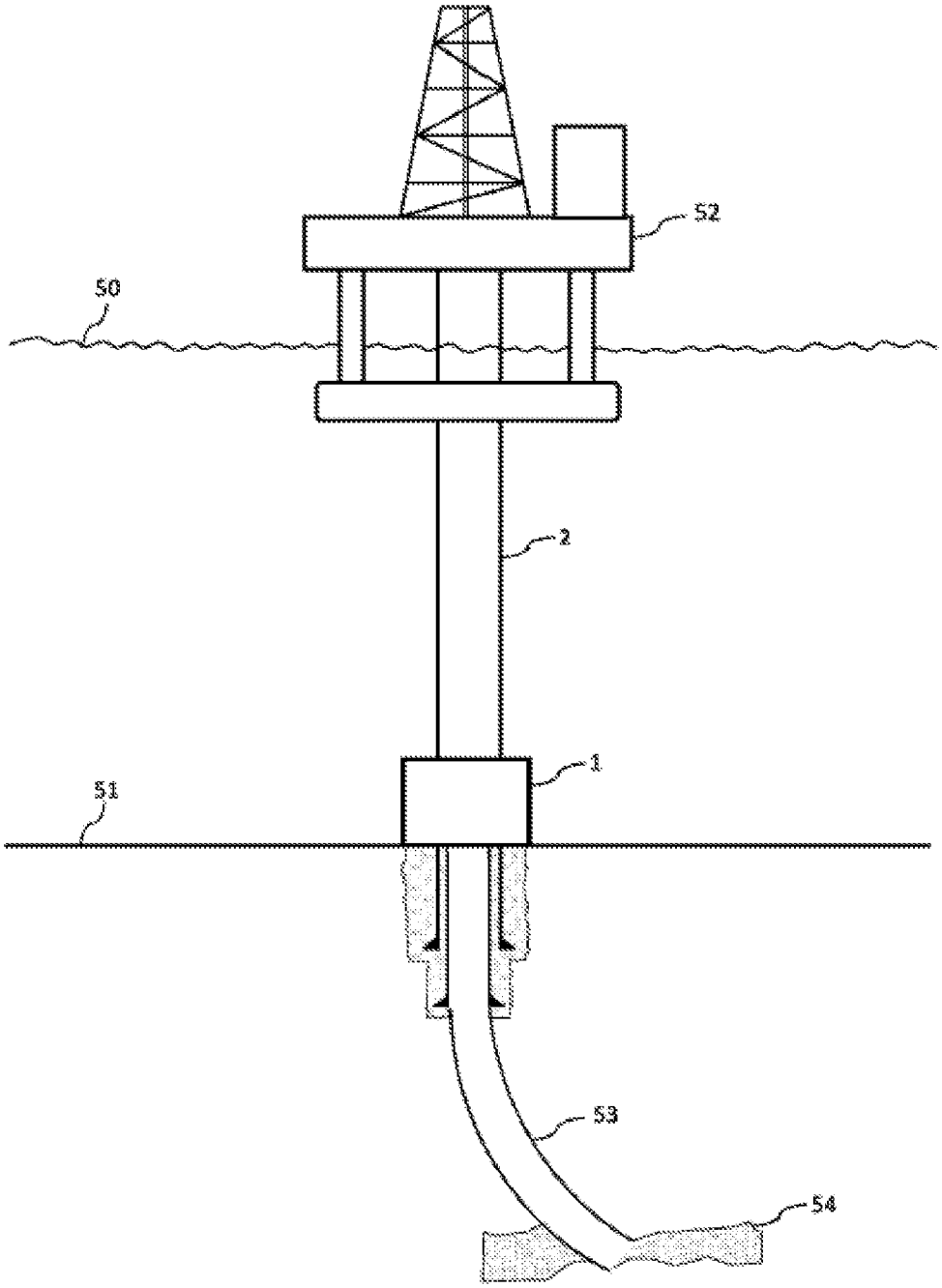
FIG. 1 shows a floating drilling rig arrangement.

In an embodiment, there is provided a method and apparatus for managed pressure drilling (MPD) that can be used in deep or ultra-deep water when drilling with a floater with a subsea BOP stack, utilizing the marine drilling riser and the riser auxiliary tubulars commonly named booster line (fluidly connected to the riser) and kill & choke line (fluidly connected to the subsea BOP stack). The basic principle may be the same as for MPD carried out onshore with a rotating control device (RCD) installed above the BOP with one important difference that the RCD is replaced with a column of a first fluid in the riser annulus that is heavier than the second fluid used for drilling.

In one embodiment, the system is used for pressurized mud cap drilling (PMCD). A first fluid, typically a viscous mud heavier than seawater, is circulated down the booster line and up the riser annulus back to the mud system at a substantially constant pump rate. The circulation of the first fluid (the heavier mud) may also be circulated from the top of the riser through the trip tank and riser fill-up line (not shown on the drawing) after the entire riser has been displaced with the heavier mud but through the booster line. In this way, the viscous heavy mud may intentionally be left stagnant in order to gel up in the riser annulus. Alternatively, it is also possible to locate a high viscous fluid between the booster line inlet and the kill or choke line outlet.

A second fluid, typically seawater, is pumped down the drill pipe and injected together with drilled cuttings into the loss zone. A check valve or float (or, typically, two in series) is used in the bottom hole assembly (BHA) to avoid fluid flowing back during connection. Seawater is also pumped down the kill and choke line, part of that seawater is also circulated back to the mud system via a pressure control valve (PCV) to apply surface back-pressure in order to keep a safe and constant combined hydrostatic and frictional circulation pressure below the subsea BOP stack. The PCV is also used to adjust the amount of seawater that is pumped down the wellbore annulus and into the loss zone typically in the lower part of the well. If the pore pressure gradient in the loss zone is lower than the pore pressure gradient higher up in the same open wellbore, seawater can be pumped down the wellbore annulus at a sufficient flow rate to create a frictional pressure drop in the annulus to enable the entire wellbore to have an equivalent circulation density (ECD) higher than the highest pore pressure gradient in the open wellbore. By continuous circulating and injecting seawater through the kill and choke line, a constant combined hydrostatic and frictional circulation pressure below the subsea BOP stack can be maintained also during connection. During tripping, it can be desirable to close the BOP when the drilling bit is above the subsea BOP to avoid mud being lost to the formation in case the frictional pressure drop in the open wellbore is not high enough to maintain a safe and constant combined hydrostatic and frictional circulation pressure below the subsea BOP stack.

Sometimes when total loss is experienced and drilling is continued using the above mentioned PMCD technique, the loss rate may decrease. The system can then also be used for managed pressure drilling (MPD) and obtain a safe minimum annulus pressure higher than the highest pore pressure gradient in the open wellbore, even if partial loss is experienced. A first fluid, typically heavy mud, is circulated down the booster line and up the riser annulus back to the mud system at a constant pump rate. A second drilling fluid, typically mud with a lower density than the first fluid, is pumped down the drill pipe and circulated back to the mud system via the kill and choke lines and a pressure control valve (PCV) used to apply surface back-pressure. A check valve or float (typically two in series) is used in the bottom hole assembly (BHA) to avoid fluid coming back during connection. A dedicated back-pressure pump or one of the HP mud pumps can be used to apply back-pressure during connection by circulating the drilling fluid through the PCV in the same way as used for conventional MPD with RCD.

Figure 2:
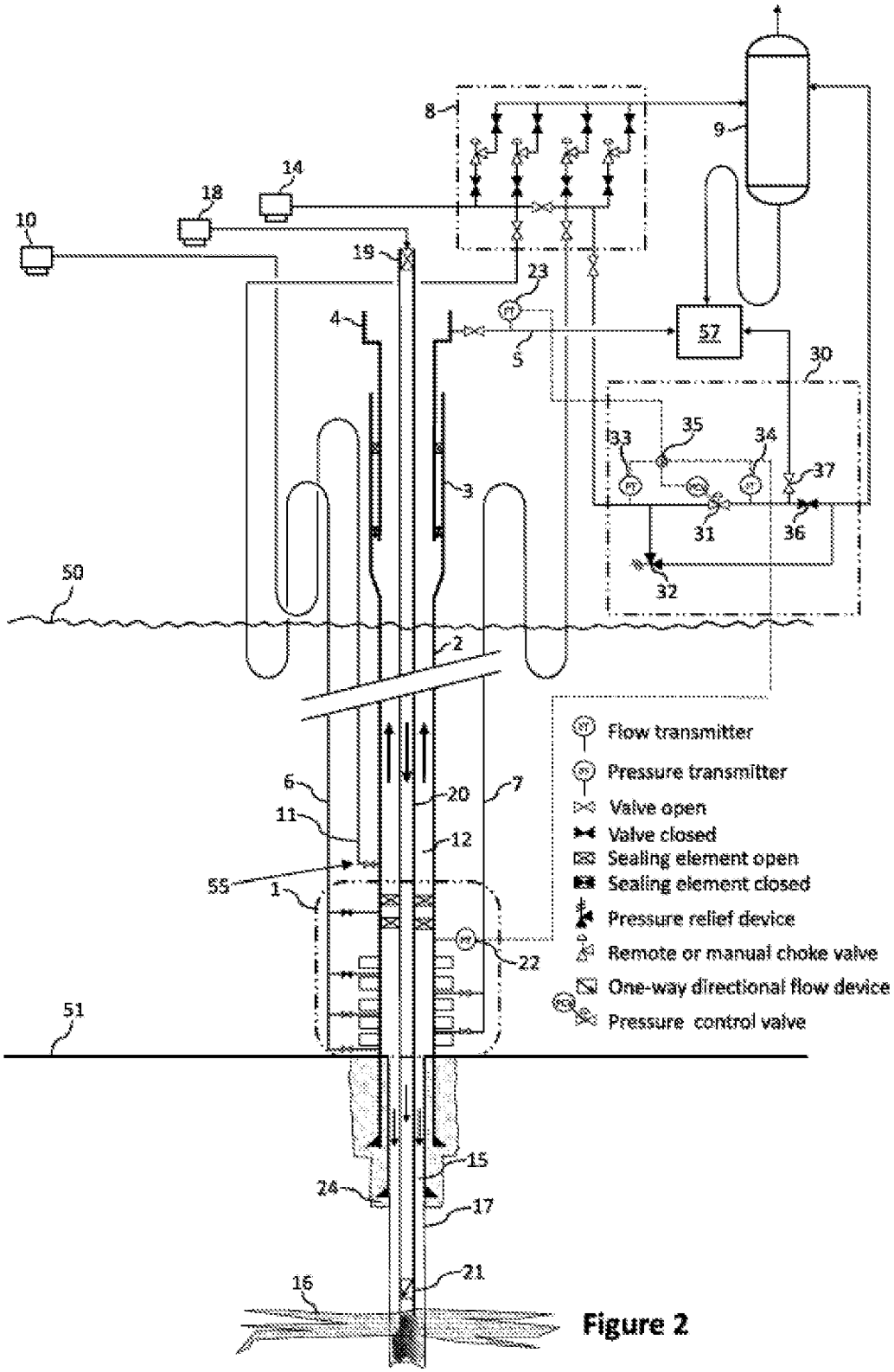
FIG. 2 is a simplified schematic showing an embodiment used for pressurized mud cap drilling (PMCD)
Figure 3:
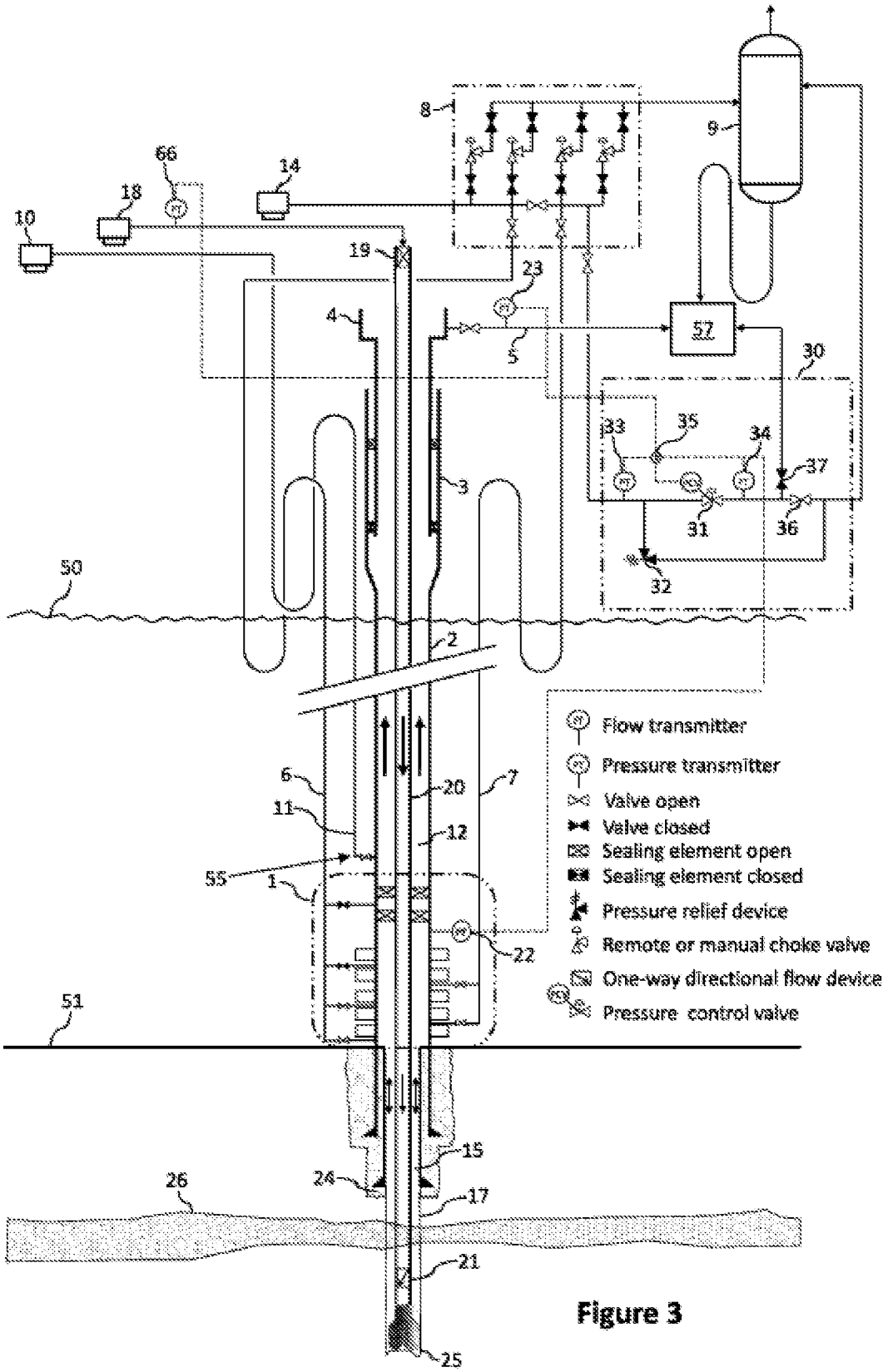
FIG. 3 is a simplified schematic showing an embodiment used for managed pressure drilling (MPD) with partial loss or when PMCD with total loss cannot any longer be achieved.

Referring now to FIG. 1, a floating drilling rig 52 floating on a sea surface 50 comprises a marine drilling riser 2 extending from the rig 52 to a subsea BOP stack 1 arranged on the sea bed 51. The drilling riser 2 is connected to a subterranean wellbore 53 extending into the underground formation and, at some point during the drilling process, into a petroleum reservoir 54. As can be seen in FIGS. 2-4, the system further comprises a slip-joint 3, a diverter housing 4 and a mud return line 5 fluidly connected to a mud system. In addition to the equipment normally available on the floating drilling rig 52, the present invention is also equipped with a managed pressure drilling (MPD) choke manifold 30. The MPD choke manifold 30 may consist of one or several pressure control valves (PCV) 31, a pressure relief device 32, a pressure transmitter (PT) 33, a flow transmitter (FT) 34 and programmable logic controller (PLC) 35. The MPD choke manifold 30 is fluidly connected to a choke line 6 and a kill line 7, either directly through a buffer manifold (not shown) or via a kill and choke manifold 8. Downstream the PCV 31 the MPD choke manifold 30 is fluidly connected to a mud gas separator (MGS) 9 and to a mud return system 57. Either a 3-way selector valve (not shown) or an isolation valve 36 and an isolation valve 37 are installed to return the fluid either directly to the mud return system 57 or via the MGS 9.

FIG. 2 is a simplified schematic showing a preferential form of embodiment of the present invention, when the invention is used for pressurized mud cap drilling (PMCD). PMCD is typically used when a total loss zone 16 is intersected by a drill string 20, and can also be associated with gas influx higher up in the same open wellbore 17. A high pressure mud pump 10 circulates a first fluid (typically mud), down a booster line 11 and up a riser annulus 12 and back to the mud return system 57 via the mud return line 5. The first fluid (mud) circulated in the riser annulus 12 has a higher density than a second fluid that is called a sacrificial fluid (typically seawater). The sacrificial fluid is pumped down the choke line 6 and/or kill line 7 using a second high pressure mud pump 14, down a wellbore annulus 15 and into the total loss zone 16. The arrows in the figure illustrate the flows of the first fluid and the sacrificial fluid. The sacrificial fluid is being pumped down the wellbore annulus 15 in sufficient amount also during connection to ensure the entire open wellbore 17 stays overbalanced, thereby preventing gas from entering the wellbore 17. The sacrificial fluid is also being pumped by a high pressure mud pump 18 through an internal blow-out preventer (IBOP) 19 located in a top drive (not shown) and down the drill string 20. The drilling string 20 is also equipped with minimum one, one-way directional flow device (float) 21, to prevent reversed flow during connection. The PCV 31 is used to balance the amount of sacrificial fluid that is pumped down the choke line 6 and kill line 7 in order to maintain a safe overbalanced pressure in the entire wellbore 17. The PCV 31 is automatically controlled by the controller 35 taking input from either calculated or measured total flow into the system, i.e. high pressure mud pumps 10, 14, 18, pressure 22 in the subsea BOP stack 1 (if available), flowrate 23 in the mud return line 5, flowrate 34 through the PCV 31 and upstream pressure 33, in order to maintain a safe overbalanced pressure in top of the open wellbore 17 below the last cemented liner or casing string 24.

FIG. 3 is a simplified schematic showing a preferential form of embodiment of the present invention, when the invention is used for managed pressure drilling (MPD), to maintain a safe overbalanced pressure in top of the open wellbore 17 below the last cemented liner or casing string 24. A high pressure mud pump 10 circulates a first fluid (a heavy annular mud), down the booster line 11 and up the riser annulus 12 and back to the mud return system 57 via the mud return line 5. The first fluid circulated in the riser annulus 12 has a higher density than a second fluid that is for drilling (typically light drilling mud). The light drilling mud is pumped by at least one high pressure mud pump 18 through an internal blow-out preventer (IBOP) 19 located in a top drive (not shown) and down the drill string 20. The drill string 20 is also equipped with minimum one, one-way directional flow device (float) 21, to prevent reversed flow during connection. A dedicated back-pressure pump or high pressure mud pump 14 is used to apply surface back-pressure by circulating through the PCV 31. The PCV 31 is automatically controlled by the PLC 35 taking input from either calculated or measured total flow into the system, i.e. high pressure mud pumps 10, 14, 18, pressure 22 in the subsea BOP stack 1 (if available), flowrate 23 in the mud return line 5, flowrate 34 through the PCV 31 and upstream pressure 33, in order to maintain a safe overbalanced pressure in top of the open wellbore 17 below the last cemented liner or casing string 24.

Figure 4A:
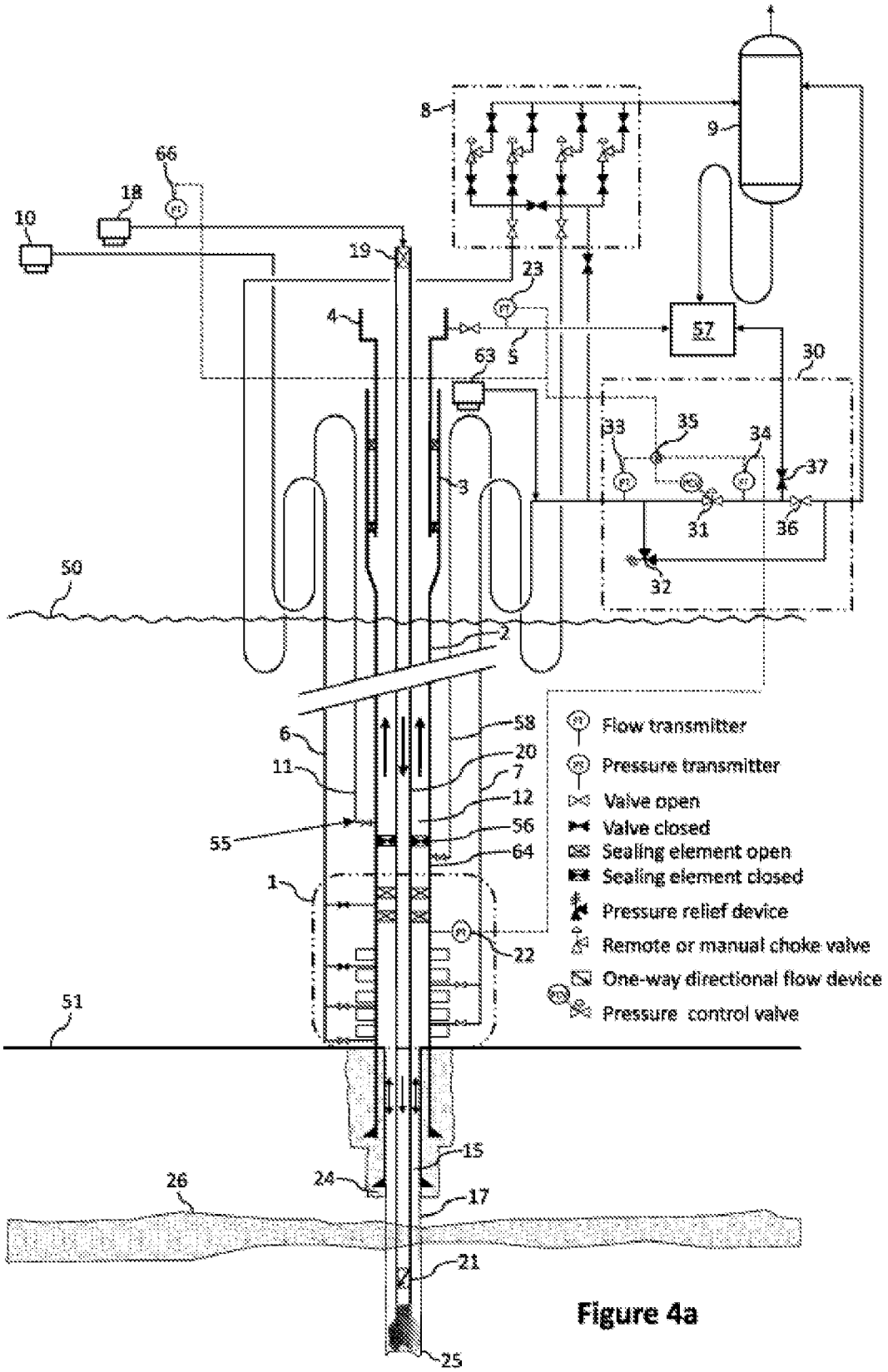
FIG. 4*a* is a simplified schematic showing an embodiment for a MPD system with a subsea installed blow-out preventer (BOP) stack, an annulus sealing element below the "low pressure" marine drilling riser and a "high pressure" cuttings and fluid return line on the outside of the marine drilling riser.

FIG. 4*a* is a simplified schematic showing a preferential form of embodiment of the present invention, when the invention is used for managed pressure drilling (MPD) with a sealing element 56 (also commonly named a rotating control device (RCD)), located in a lower region 55 of the drilling riser 2 typically below the inlet of the booster line 11. The injection of mud into the riser annulus 12 by means of the high pressure mud pump 10 (also commonly named the booster pump), and a booster line 11 is no longer used to transport drilling cuttings up the riser 2, but to circulate heavy gas free mud without cuttings and drilled gas up the riser 2. The heavier mud returning from the diverter housing 4 is taken back by the mud return line 5 to the mud system 57 and to a separate mud tank (not shown) and back to the booster pump 10, and down the booster line 11 to complete the circulation of the heavier mud returning from the diverter housing 4. The light drilling mud is pumped by at least one high pressure mud pump 18 through the internal blow-out preventer (IBOP) 19 located in a top drive (not shown) and down the drill string 20. The drill string 20 is also equipped with a one-way directional flow device (float) 21, to prevent reversed flow during connection. A dedicated return line 58 for drilled gas, cuttings and drilling fluid may be provided or the kill 6 and/or choke line 7 may be used as return lines. A dedicated back-pressure pump or high pressure mud pump 63 is used to apply surface back-pressure by circulating through the PCV 31. The PCV 31 is automatically controlled by the controller 35 taking input from either calculated or measured total flow into the system, i.e. high pressure mud pumps 10, 14, 18, pressure 22 in the subsea BOP stack 1 (if available), flowrate 34 through the PCV 31 and upstream pressure 33, in order to maintain a safe overbalanced pressure in top of the open wellbore 17 below the sealing element 56. In the case of partial or total loss scenarios, the drilling fluid is injected down the dedicated return line 58, the kill line 6 and/or choke line 7, during connection and, if necessary, also during drilling. It should be noted that injecting down the return line 58, 6, 7 during drilling is only relevant during sudden loss scenarios and PMCD to maintain a safe overbalanced pressure also in top of the open wellbore 17 and to mitigate gas influx from any top fractures in the open wellbore 17. This method to immediately fill any fracture that may be intersected during drilling can informally be denoted "dynamic pressure control" (DPC). If a standpipe pressure 66 shows an abnormal drop in pressure in combination with a flow return transmitter 34 showing that a partial or total loss of drilling fluid event has occurred, this is a strong indication that the formation fracture gradient has been exceeded or a natural fracture has been intersected. Rather than reducing the applied surface back-pressure by opening the PCV 31 to prevent severe losses, the DPC method will increase applied surface back-pressure by closing the PCV 31. The purpose of increasing the applied surface back-pressure is to be able to force fluid down the return line 58, 6, 7, supplied by the back-pressure pump 63. The fluid injected will compress the fluid in the fracture and fill the fracture with drilling fluid as quick as possible in order to avoid a temporary drop in the wellbore 17 annulus 15 pressure. The purpose of the DPC method is to maintain a safe overbalanced pressure also in top of the open wellbore 17 and to mitigate gas influx from the top fractures or higher pressured reservoirs in the open wellbore 17 even during loss events and crossflow events.

Figure 4B:
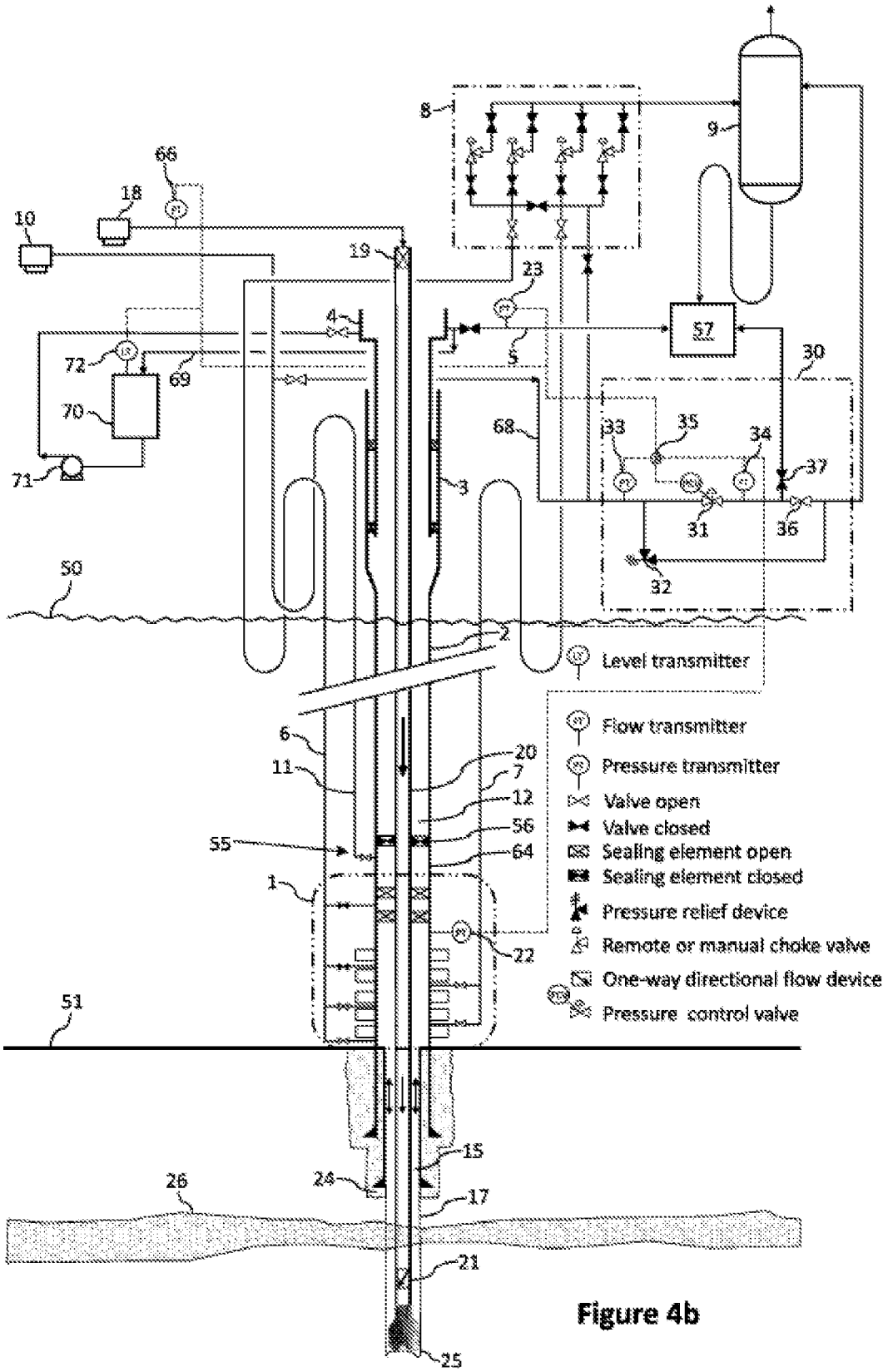
FIG. 4*b* is a simplified schematic showing an embodiment for a MPD system with a subsea installed blow-out preventer stack utilizing the booster line for cuttings and fluid return back to the MPD choke.

FIG. 4*b* is a simplified schematic showing a preferential form of embodiment of the present invention used for managed pressure drilling (MPD). The main difference between FIGS. 4*a* and 4*b* is that the first fluid conduit 11 (also called the booster line) is used as a return line for drilled gas, cuttings and drilling fluid. The booster line 11 is no longer connected to the riser annulus 12 above the RCD 56 but instead is connected to the annulus space 15 below the RCD 56. The high pressure mud pump 10 is used to apply surface back-pressure by circulating drilling fluid through the PCV 31. A common fluid conduit 68 will take both cuttings and fluid returning from the wellbore 17 through the booster line 11 and the fluid being pumped by the high pressure mud pump 10. The high pressure mud pump 10 and the booster line 11 may also be used to change or circulate the heavier first fluid in the riser annulus 12, by means of closing a subsea BOP 1 and opening the sealing element 56. However, when the system is in drilling mode, the subsea BOP 1 is open and the sealing element 56 is closed. To ensure the riser annulus 12 is filled at all times with the heavier first fluid, a tank 70, such as a trip tank, will be filled up and the first fluid circulated by means of a circulation pump 71, such as a trip tank pump, up to the diverter housing 4 where excess fluid is drained back by means of a fluid conduit 69. Potential loss of the heavier fluid in the riser annulus 12 due to leaks in the RCD 56 will be monitored by a level transmitter 72 and the riser annulus 12 will be continuously filled by means of the circulation pump 71.

Figure 5:
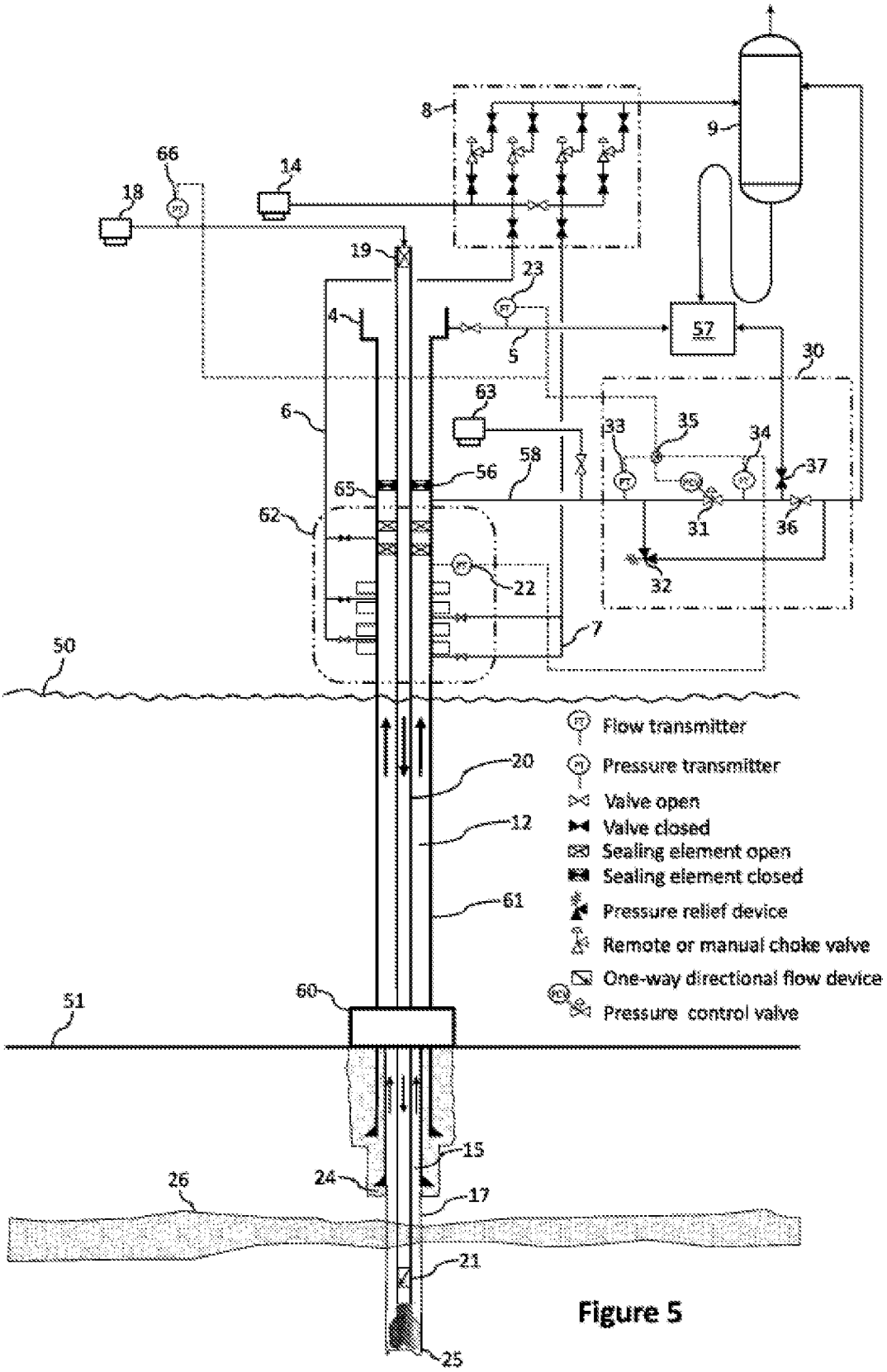
FIG. 5 is a simplified schematic showing an embodiment for a MPD system with a surface installed blow-out preventer stack.

FIG. 5 is a simplified schematic showing an MPD system with a surface installed BOP stack 62, located above the sea surface 50. The figure shows a typical installation offshore with a subsea wellhead 60 located on the seabed 51 and with a high pressure riser or a tubular 61 fluidly connecting the wellhead 60 with the surface BOP stack 62. The MPD system shown typically further consists of an RCD 56 located above the surface BOP stack 62, and a short flow spool 65 fluidly connected with fluid return line 58 connected to a MPD choke manifold 30. The system shown is typically used for fixed installation offshore and drilling units supported from the seabed (jack-ups). However, a similar system may also be used for MPD systems onshore, where the surface BOP stack 62 typically is installed directly on the wellhead 60. The purpose with this FIG. 5 is to show that the dynamic pressure control (DPC) method described under FIG. 4*a* may also be used for any MPD systems where rapid change of downhole pressure can be achieved.

Figure 6:
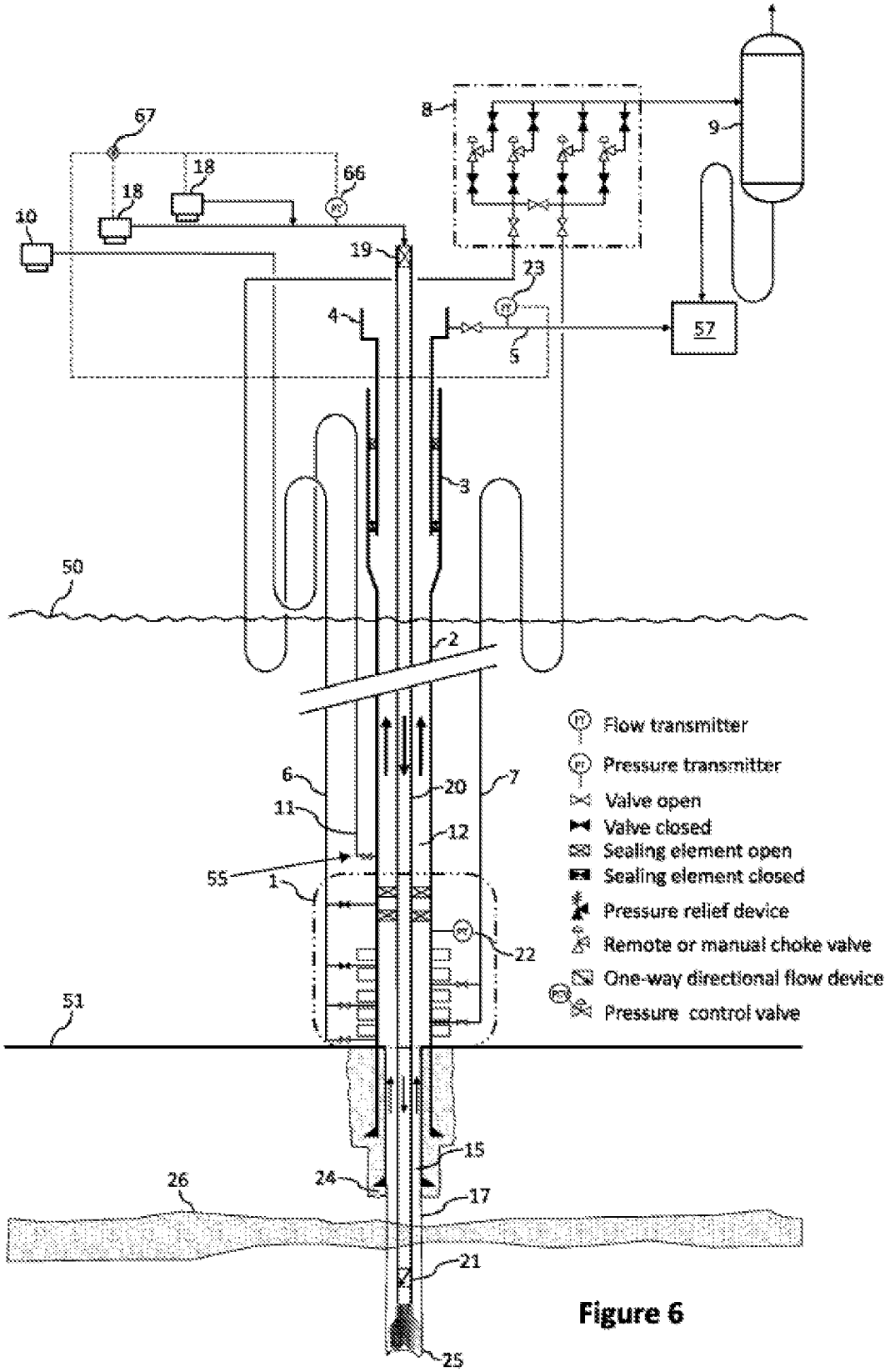
FIG. 6 is a simplified schematic showing a conventional drilling system.

FIG. 6 is a simplified schematic showing a typical conventional drilling application with no MPD system provided. The figure shows a typical offshore installation with a subsea BOP stack 1 and a low pressure riser 2, however the same dynamic pressure control (DPC) method is also valid for other conventional installation onshore and offshore with a surface installed BOP stack. In this case since it takes time to close the BOP stack 1 and since in this case there is no MPD system installed, the DPC method will be obtained by instantly increasing the flowrate down the drillstring 20. If the standpipe pressure 66 shows an abnormal drop in pressure in combination with a flow return transmitter 23 showing that a partial or total loss of drilling fluid event has occurred, this is a strong indication that the formation fracture gradient has been exceeded or a natural fracture has been intersected. Rather than reducing the flowrate from the high pressure mud pumps 18 to prevent severe losses, the DPC method will automatically increase the high pressure pump 18 speed by a controller 67. The purpose of the DPC method is to reduce the potential influx of gas caused by a sudden loss or crossflow event, due to a temporary drop in the open wellbore 17 annulus 15 pressure.

According to certain embodiments described herein, new systems and methods for managed pressure drilling (MPD) for a floater with subsea BOP stack, enabling drilled gas and inadvertent influx of gas under pressure to be treated in a high pressure system through a high pressure dedicated return line, a booster line, and a choke and/or kill line connected to the subsea BOP stack. Embodiments also include a dynamic pressure control (DPC) method that can be applied to any drilling system, although it will be most effective for an MPD system that enables rapid change of downhole pressure.

Some advantages that can be realized with embodiments according to the presented invention can be summarized as follow:

- No drilled gas or inadvertent influx of gas is handled in the marine drilling riser.
- Gas influx can be handled by the MPD system in a high pressure system either through a dedicated high pressure return line, the high pressure booster line or the K&C lines.
- Utilizing the existing booster line and hose for cuttings and fluid returning to the MPD system may also reduce the CapEx and/or OpEx associated with current MPD systems and methods for a floater with a subsea BOP stack.
- Locating the RCD above the subsea BOP stack with a filled riser annulus with heavier mud above leaves the RCD out of the primary barrier envelope.
- The MPD system can still be operated even with a leaking RCD since fluid will leak down and not up and into the riser.
- The DPC™ method can avoid or reduce influx caused by partial or total loss.
- The DPC™ method can avoid or reduce influx caused by potential crossflow events.
- The DPC™ method can avoid or reduce influx and gas migration during PMCD.
- The DPC™ method can avoid or reduce further influx caused by gas hydrates forming in the wellbore after a gas influx event.
- The DPC™ method can avoid or reduce potential wellbore stability issues, such as wellbore collapse and stuck pipe caused by an influx event.
- The DPC™ method can avoid or reduce the problems of downhole pressure fluctuations due to surge and swap associated with drilling with a floater in harsh environment and narrow drilling window.

The invention has been described in non-limiting embodiments. It is clear that the person skilled in the art may make a number of alterations and modifications to the described method without diverging from the scope of the invention as defined in the attached claims.

What is claimed is:

1. A method for managed pressure drilling, comprising the steps of:

extending a drilling riser having a drill string therein from a floating installation to a location on a seafloor, the drilling riser being fluidly connected to a subsea blow-out preventer stack and equipped with:

a first fluid conduit extending from the floating installation to a lower region of the drilling riser proximate to but above the subsea blow-out preventer stack, the first fluid conduit being fluidly connected with a drilling riser annulus residing between the drill string and the surrounding drilling riser, and a second fluid conduit extending from the floating installation and fluidly connected to the drilling riser annulus through the subsea blow-out preventer stack;

providing a first fluid in the drilling riser annulus via the first fluid conduit;

providing a second fluid in the second fluid conduit and inside the drilling riser annulus below the first fluid, with the second fluid extending below the subsea blow-out preventer stack, wherein the first fluid has a higher density than the second fluid;

circulating the second fluid through a control valve residing at the floating installation, which is fluidly connected to the second fluid conduit; and using a controller, operating the control valve to apply a surface back-pressure so as to obtain a pre-determined, combined hydrostatic and frictional circulation pressure for the second fluid below the subsea blow-out preventer stack;

and wherein the first fluid conduit is a drilling riser booster line, and the second fluid conduit is a kill line and/or a choke line.

2. The method of claim 1, further comprising:

using a pump, circulating the first fluid down the first fluid conduit and up the drilling riser annulus.

3. The method of claim 1, wherein the second fluid density is set such that the hydrostatic pressure acting on an open wellbore section below the subsea blow-out preventer stack is lower than or equal to a lowest formation pore pressure in the open wellbore section.

4. The method of claim 1, further comprising:

providing a one-way valve in a lower part of the drill string.

5. The method of claim 1, wherein operating the control valve to apply a surface back-pressure produces a hydrostatic pressure acting on an open wellbore section below the subsea blow-out preventer stack which is higher than a formation pore pressure in the open wellbore section.

6. The method of claim 1, wherein:

the second fluid is a sacrificial fluid, and the method further comprises pumping the sacrificial fluid through the drill string and/or through the second fluid conduit and into a weak formation zone along an open wellbore section below the subsea blow-out preventer stack.

7. The method of claim 6, further comprising:

controlling the flow rate of the sacrificial fluid such that a hydraulic pressure acting on the open wellbore section is higher than a formation pore pressure in the open wellbore section.

8. The method of claim 7, further comprising:

connecting a section of drill pipe to the drill string at the floating installation while pumping the second fluid down through the second fluid conduit and through the control valve at the floating installation.

9. The method of claim 1, further comprising:

pumping the second fluid through the drill string and up the second fluid conduit, and through the control valve at the floating installation.

10. The method of claim 1, wherein operating the control valve to apply a surface back-pressure produces a pre-determined, substantially constant pressure at the subsea blow-out preventer stack to maintain a level of the second fluid.

11. The method of claim 1, further comprising:

arranging a sealing element between the subsea blow-out preventer stack and the drilling riser, the sealing element being configured to seal the drilling riser annulus above the sealing element and below the sealing element around the drill string, and the sealing element residing along the lower region of the drilling riser proximate the subsea blow-out preventer stack; and providing the first fluid above the sealing element and the second fluid below the sealing element.

12. A managed pressure drilling system, comprising:

a drilling riser having a drill string therein, extending from a floating installation to a location on a seafloor, the drilling riser being fluidly connected to a subsea blow-out preventer stack and equipped with:

a first fluid conduit extending from the floating installation to a lower region of the drilling riser proximate to but above the subsea blow-out preventer stack, the first fluid conduit being fluidly connected with an annulus space around the drill string, a second fluid conduit extending from the floating installation to the subsea blow-out preventer stack and fluidly connected to the annulus space;

a sealing element arranged within the drilling riser above and proximate to the subsea blow-out preventer stack, the sealing element being configured to seal the annulus space around the drill string;

a first fluid provided in the annulus space above the sealing element via the first fluid conduit, and a second fluid provided in the second fluid conduit and in the annulus space below the sealing element, wherein the first fluid has a higher density than the second fluid;

a control valve fluidly connected to the first fluid conduit and/or the second fluid conduit; and a controller configured to operate the control valve at the floating installation to apply a surface back-pressure so as to obtain a pre-determined, combined hydrostatic and frictional circulation pressure for the second fluid in the annulus space below the sealing element.

13. The system according to claim 12, further comprising:

a third fluid conduit extending from the floating installation to a position below the sealing element, the third fluid conduit being fluidly connected with the annulus space and fluidly connected with the control valve.

14. The system of claim 13, wherein a tubular defining the annulus space below the sealing element, the third fluid conduit and the control valve is designed with a higher maximum allowable operating pressure than the drilling riser.

15. The system of claim 12, wherein the first fluid is configured such that a hydrostatic pressure from the first fluid acting on the sealing element from above is higher than or equal to the pre-determined, combined hydrostatic and frictional circulation pressure provided by the control valve and the second fluid acting on the said sealing element from below.

16. The system of claim 12, further comprising:

a combined fluid injection and back-pressure pump fluidly connected to the control valve and to at least one of the first fluid conduit, the second fluid conduit and third fluid conduit.

17. The system of claim 16, wherein the combined fluid injection and back-pressure pump is a high pressure mud pump.

18. The system of claim 12, further comprising:

a one-way valve arranged in a lower part of the drill string.

19. The system of claim 12, wherein the combined hydrostatic pressure from the first fluid provided in the annulus space around the drill string above the sealing element and the second fluid provided below the sealing element and acting on an open wellbore section is higher than a formation pore pressure.

20. The system of claim 12, further comprising:

a fluid conduit fluidly arranged between a diverter housing and a tank and fluidly connected to a pump configured to circulate the first fluid between the diverter housing and the tank and to maintain a fluid level in the annulus space around the drill string.

21. The system of claim 20, further comprising:

a level transmitter configured to monitor the fluid level in the riser and to identify any potential loss of fluid through the sealing element.

22. The system of claim 20, wherein:

the tank is a trip tank, the first fluid conduit is a drilling riser booster line and the second fluid conduit is a choke line and/or a kill line.

23. A method for dynamically operating a managed pressure drilling system, the system comprising:

a control valve on a drilling platform, a tubular extending from the drilling platform down to an earth surface;

a blow-out preventer stack below the drilling platform, the tubular being fluidly connected to the blow-out preventer stack, a drill string within the tubular also extending from the drilling platform and down through the blow-out preventer stack, a sealing element residing above the blow-out preventer stack and arranged to seal an annulus space between the drill string and the surrounding tubular, a fluid conduit also extending from the drilling platform and fluidly connected to the annulus space below the sealing element, and a managed pressure drilling choke manifold containing the control valve and fluidly connected to the fluid conduit at the drilling platform, and the method comprising:

operating a fluid pump to inject a fluid into the fluid conduit and to circulate the fluid through the control valve from the fluid conduit; and operating a controller to apply an increased surface back-pressure via the control valve and/or the fluid pump if a loss of circulation is detected simultaneously with a drop in drilling fluid circulation pressure so as to force the fluid down the fluid conduit and down the annulus space below the sealing element to maintain a predetermined pressure for the fluid below the blow-out preventer stack.

24. The method of claim 23, further comprising:

operating a pump to pump a drilling fluid through the drill string and into the wellbore.

25. The method of claim 23, wherein:

the drilling platform is a floating offshore platform;

the tubular is a low pressure marine drilling riser;

the earth surface is a seabed; and the blow-out preventer stack is a subsea blow-out preventer stack.

26. The method of claim 23, wherein:

the earth surface is a seabed or onshore dry land;

the drilling platform is a fixed installation offshore, a drilling unit supported from the seabed or an onshore drilling facility;

the tubular is a high pressure tubular designed for full shut-in pressure; and the blow-out preventer stack is located at the surface above the sea level or dry land.

* * * * *